166-308 SR
12/28/76 XR 3,999,609

United States Patent [19]

Field

[11] 3,999,609

[45] Dec. 28, 1976

[54] EXPLOSIVE WELL STIMULATION METHOD

[75] Inventor: Harold S. Field, Pampa, Tex.

[73] Assignee: Cabot Corporation, Boston, Mass.

[22] Filed: June 9, 1975

[21] Appl. No.: 584,767

[52] U.S. Cl. ..... 166/299; 102/21; 166/308

[51] Int. Cl.[2] ..... E21B 43/26

[58] Field of Search ..... 166/63, 299, 308, 256, 166/259; 102/21, 29; 175/2

[56] References Cited

UNITED STATES PATENTS

| | | | |
|---|---|---|---|
| 3,616,857 | 11/1971 | Pitkethly et al. | 166/299 |
| 3,727,690 | 4/1973 | Munson | 166/299 |
| 3,885,499 | 5/1975 | Hurley | 102/29 |

*Primary Examiner*—Ernest R. Purser
*Attorney, Agent, or Firm*—Jack Schuman; Barry R. Blaker; Lawrence A. Chaletsky

[57] ABSTRACT

There is disclosed herein an improved method of well stimulation involving the use of explosive mixtures performed downhole and employing the combustible components of the fossil fuel producing formation as the fuel component of the explosive mixture.

8 Claims, 1 Drawing Figure

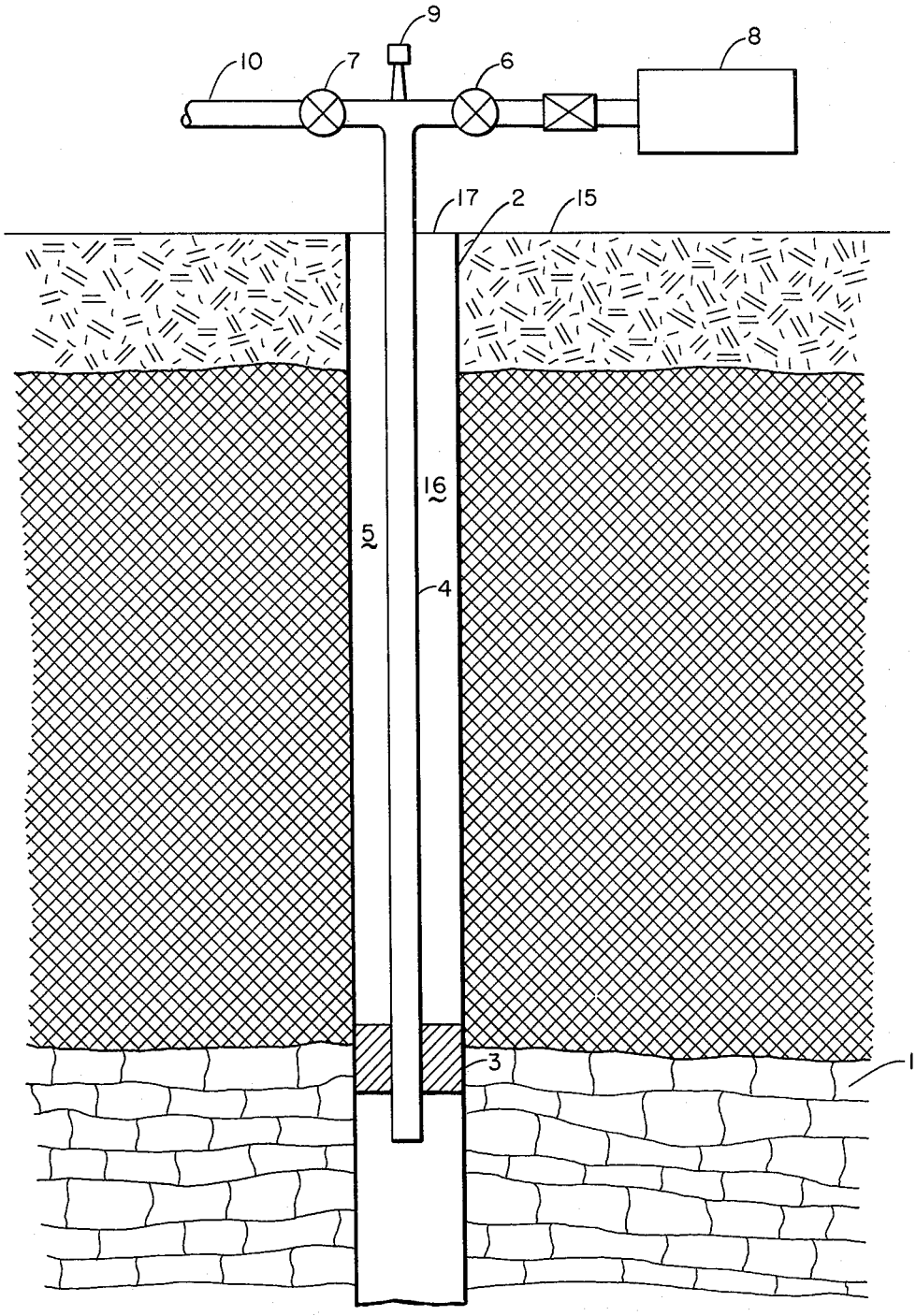
9
10
7
6
8
17
2
15
16
5
4
3
1

EXPLOSIVE WELL STIMULATION METHOD

BACKGROUND OF THE INVENTION

1. Field of the Invention

This invention relates generally to well stimulation and is more particularly concerned with an improved method of well stimulation by explosive fracturing.

2. Description of the Prior Art

In view of the extensive and continuing depletion of existing gas and oil reserves there has developed an intensive search for methods by which wells can be stimulated so as to foster additional and economic recovery of valuable fossil fuels therefrom. As employed herein, the term "well stimulation" refers to any method employed to enlarge or create new flow fissures in a downhole fuel producing or "pay" formation. Generally speaking, three broad categories of well stimulation techniques are known, each of which bears certain disadvantages.

Hydraulic fracturing represents one of these categories and is presently widely practiced. In hydraulic fracturing a liquid is injected into the well bore under relatively enormous pressure, thereby to cause splitting and fracturing of the "tight" pay formation. This method finds particular use with respect to sandstone pay formations which are not normally sufficiently amenable to stimulation by means of acidification techniques. While the principal purpose of the liquid employed in hydraulic fracturing is to act as a pressure transfer agent and to thereby transmit the pressure generated at the surface of the well site to the downhole formation, said liquid is also often additionally employed as a carrier for sand or other particulate solids. These solids are conveyed by the liquid into the fissures caused by the hydraulic fracturing and thereafter serve to stabilize the fractured formation and to ensure maintenance of the freshly opened fissures. Typical hydraulic liquids comprise refined oil, crude oil, salt water, acids, emulsifiers and other additives. Principal disadvantages of well stimulation by hydraulic fracturing lie in the expense involved in providing the various and complex equipments required to generate the relatively enormous downhole hydraulic pressures, which may exceed 10,000 p.s.i., and in the safety hazards associated with handling of such relatively enormous captive pressures. Too, hydraulic fracturing is usually a relatively lengthly process to undertake.

Another broad category of well stimulation technique resides in acid treatment of susceptible pay formations. Depending upon the nature and composition of the formation, one or more acids are pumped downhole to the formation and, upon contact therewith, cause channeling and fissuring by chemical reaction. Acid treatment well stimulation techniques find fairly extensive use with respect to pay formations composed of limestone or dolomite which, as a result of their composition, are especially susceptible to hydrochloric acid attack. Various other acids and acid treating formulations can be employed. For instance, hydrofluoric acid and mixtures thereof with hydrochloric acid are often employed when the producing formation to be stimulated comprises clay or sandstone or wherein a portion of the overall stimulation process is directed to the removal of mud from the pore space about the well. Rheological acid compositions are also employed and are generally introduced into the well as a fluid liquid. At the formation site, however, a rheological acid composition tends to set up as a viscous mass, thereby to retard its chemical action until such time as it has found its way back into the tight formation. A major problem usually associated with well stimulation by acid treatment resides in the requirement that the spent acid be periodically or continuously removed from the formation and replaced by fresh acid. This, of course, requires that the spent acid be swabbed or pumped out of the well and that suitable provisions be made for the disposal thereof. Further, should the acid treating agent be left downhole, it can substantially reduce the service life of the pump and other equipment associated with the well.

The third general category of well stimulation technique known in the art, with which category the present invention is associated, is known broadly as explosive fracturing. Explosive fracturing is probably the most venerable of well stimulation techniques and is usually achieved by placing an explosive charge downhole and detonating it so as to shatter the tight pay formation and thereby permit the oil or other fossil fuel of interest to flow through the rubble to the well. Historically, the first methods of explosive fracturing involved the use of pure nitroglycerin which, of course, is an extremely dangerous and sensitive explosive. This problem has been mollified somewhat by the advent of safer explosives which are generally lowered into the well in combination with timed detonators. More recent developments with respect to explosive fracturing techniques involve the use of explosive liquids which are pumped into the pores of the pay formation and are thereafter detonated. Unfortunately, such liquid explosives are also often of a critical compositional nature and are overly sensitive to shock, static electricity, heat and the like. Several serious accidents have already been experienced in association with their use. Atomic explosives have been experimentally employed in fracturing wells and some successes have been had in creating massive fracturing of tight pay formations by this technique in gas wells located in New Mexico and Colorado. Obviously, however, the use of atomic or thermonuclear charges is, as yet, extremely expensive for this purpose and additional safety problems are incurred with respect to proper and safe disposition of radioactive wastes. Finally, the use of explosive fracturing techniques of the prior art in attempting to stimulate a well can often result in substantial downhole cave-ins of the well, thereby choking it with debris. Thus, when explosively fracturing a well in accordance with prior art practices, it is often necessary to remove debris by such ancillary techniques as sand bailing or backflushing of the well bore with a pumped carrier liquid. In accordance with the present invention, however, many of the problems associated with prior art explosive fracturing stimulation techniques have been solved or at least substantially ameliorated.

OBJECTS OF THE INVENTION

It is a principal object of the invention to provide a novel method for stimulating fossil fuel producing wells.

It is another object of the invention to provide an improved method for explosive well fracturing.

It is still another object of the invention to provide an improved method for fossil fuel producing well stimulation by explosive fracturing wherein surface handling of explosive compositions is essentially completely avoided.

It is another object of the invention to provide an improved method for fossil fuel producing well stimulation by explosive fracturing wherein the explosive charge is performed downhole, remote from the well surface, and wherein natural constituents of the well are employed in performing the explosive fracturing charge.

It is still another object of the invention to provide an improved method for well stimulation by explosive fracturing wherein initiation of detonation of the downhole fracturing charge is achieved at the well surface.

It is still another object of the invention to provide an improved method for fossil fuel producing well stimulation by explosive fracturing wherein deleterious cave-ins of the well at the shot site are substantially reduced.

Other objects and advantages of the invention will, in part, be obvious and will, in part, appear hereinafter.

SUMMARY OF THE INVENTION

In accordance with the present invention, stimulation of a fossil fuel producing well is achieved by: isolating that portion of the well bore associated with the pay formation to be fractured; injecting into said isolated portion an oxygen-containing gas in an amount to form an explosive mixture with the combustible fossil fuel components contained therein; and detonating the resulting explosive mixture.

THE DRAWING

The drawing forming part hereof is a schematic, diagrammatic, sectionalized side view of a fossil fuel producing well having associated therewith apparatus for performing the well stimulation technique of the invention.

DESCRIPTION OF THE PREFERRED EMBODIMENTS

Referring now to the drawing, there is disclosed a well bore 2 extending downwardly from ground surface 15 through a tight fossil fuel producing pay formation 1. In carrying out the well stimulation of the invention, a packer 3, which may be of conventional construction, is lowered in well bore 2 and secured at a level corresponding to the top of the formation to be stimulated. Thus, that portion of the well bore 2 associated with the pay formation to be fractured is placed in isolation from the remainder of the well bore. Where the well bore 2 extends substantially below the pay formation to be treated, a straddle packer arrangement comprising both upper and lower packers can be employed, the lower packer serving to isolate the bottom of the well bore 2 associated with the pay formation from communication with that portion of the well bore depending below said formation. The isolation of that portion of the well bore 2 associated with the pay formation from the remainder of the well bore is necessary in order to concentrate the explosive forces to be generated therein and in order to avoid damage to formations lying above and below the pay formation.

Tubing 4 extends from wellhead 17 downwardly through the packer 3, thereby establishing fluid communication between the ground surface 15 and the isolated portion of the well bore associated with the tight pay formation 1. In order to further improve isolation of said portion of well bore 2, the annular space 16 formed between tube 4 and the portion of the well bore lying above packer 3 can be filled with a suitably weighty liquid material such as water or drilling fluid. Said annular fill of liquid material prevents leakage gas from accumulating in the annulus and also results in the application of substantial and generally beneficial mass to the top of the packer 3. At the wellhead 17, the tubing 4 is equipped with a valved connection to an oxygen-containing gas supply 8. Said gas will have a minimum oxygen content of at least about 20 volume %. Therefore, said supply 8 can take the form of an air compressor wherein ambient air is compressed and forced into tube 4. Alternatively, the oxygen-containing gas supply 8 can also take the form of compressed oxygen tankage or mixtures of oxygen with other gases or can even take the form of liquified oxygen. The principal requirement of the oxygen-containing gas supply 8 is that it be capable of supplying the oxygen-containing gas under a pressure greater than that of the pay reservoir pressure.

In operations, exhaust valve 7 is closed and oxygen-containing gas supply valve 6 opened, thereby permitting the oxygen-containing gas to flow from supply 8 through tube 4 and packer 3 into the isolated portion of the well bore 2 associated with the tight pay formation 1. It is in the nature of things that the fossil fuel producing pay formation 1 release combustible components, such as natural gas, casinghead gas, oil vapors and the like into the well bore. It is these combustible components which constitute the fuel element for the explosive mixtures of the invention. Accordingly, it is further in the nature of things that the oxygen-containing gas flowing into the isolated portion of the well bore will mix with said combustible components such that the explosive limit for the mixture will ultimately be obtained. The composition of the combustible components for any particular well can generally be estimated as can be the rate of release thereof from the formation 1. Consequently, the quantity of oxygen-containing gas required to attain this explosive limit can normally be estimated. Indeed, utilizing this knowledge, it is also often possible to control the oxygen/fuel ratio to either side of stoichiometric conditions and thereby afford substantial control over the explosive force generated upon subsequent detonation of the mixture.

After sufficient oxygen-containing gas has been admitted through tube 4, oxygen-containing gas supply valve 6 is closed and exhaust valve 7 opened. The reservoir pressure, being greater than atmospheric, will thus force the gas mixture performed in the isolated portion of well bore 2 to flow upwardly through tube 4 and to be vented to the atmosphere through exhaust valve 7 and discharge outlet 10. An igniter 9, which may be a spark plug or glow plug, is stationed so as to intercept the gases being exhausted and is desirably placed into continuous operation at the time of opening of exhaust valve 7. The initial return flow of gases through tube 4 will generally comprise only the oxygen-containing gas existing in tube 4 at the time oxygen-containing gas supply valve 6 is closed. Accordingly, the initial flow of gases flowing past igniter 9 will not ordinarily be of a combustible nature and ignition will not occur. Eventually, however, a portion of the explosive mixture formed in the isolated portion of well bore 2 will course its way upwardly through tube 4 to be intercepted by the operating igniter 9, thereby initiating the shot at wellhead 17. The initiation of the shot having thus been accomplished at the surface of the well, the detonation front will propagate downhole through tube 4 and the bulk of the explosive mixture will thus be detonated in the isolated portion of well bore 2. Subsequent to the explosion, the resulting gases will, of course, flow upwardly through tube 4 and be exhausted to the atmosphere through exhaust outlet 10.

In a much preferred embodiment of the well stimulation technique of the invention, the above-described shooting cycle will be repeated a number of times, each shot thereby progressively further opening the tight pay formation. Thus, after the first shot, the formation will have been fractured to only a relatively small extent as compared with the total fracturing thereof desired. After exhausting the exhaust gases from said first shot, therefore, the pay formation 1, now slightly opened, is allowed to resupply combustible fossil fuel components into the well bore, thereby to reconstitute, in situ, the fuel component of the succeeding explosive mixture. Since at least some fracturing of the formation has taken place, the effective volume thereof being incrementally increased, the resupply of the fuel is desirably permitted to build up to a somewhat larger quantity than was present for the previous shot. Then, the oxygen-containing gas supply cycle is renewed, the quantity of oxygen supplied being such as to take into account the quantity of fuel available. In this manner, the fracturing of the tight formation is undertaken in a progressive manner employing relatively mild shots and thereby mitigating against destructive cave-ins of the well bore.

What is claimed is:

1. A method for stimulating fossil fuel producing wells by explosive fracturing which comprises:

A. isolating that portion of the well bore associated with the tight pay formation from the remainder of the well bore and placing said isolated portion into tubular fluid communication with the wellhead;

B. introducing an oxygen-containing gas into said tubular communication at the wellhead and at greater than pay reservoir pressure, thereby causing flow of said oxygen-containing gas downhole into said isolated portion of the well bore, the amount of oxygen-containing gas so introduced being sufficient to form an explosive mixture with the fossil fuel components contained therein;

C. exhausting said tubular communication at the wellhead thereby to cause flow of the gases contained in said communication and the explosive mixture performed in the isolated portion of the well bore to the wellhead; and D. igniting the explosive mixture within said tubular communication at the wellhead, thereby to initiate detonation of the explosive mixture contained in said isolated portion of the well bore.

2. The method of claim 1 wherein well stimulation is achieved as a plurality of explosive fracturing detonations, each undertaken in accordance with steps (A) through (D) and wherein, subsequent to each detonation, the gaseous products of the previous explosion are exhausted from the isolated portion of the well bore and fossil fuel components are allowed to build up therein prior to the succeeding detonation.

3. The method of claim 2 wherein, prior to each succeeding detonation, a greater quantity of fossil fuel components are allowed to build up in the isolated portion of the well bore than was present in the previous explosion and wherein a correspondingly greater quantity of oxygen-containing gas is introduced in step (B) than in the previous explosion.

4. The method of claim 1 wherein the oxygen-containing gas is air.

5. The method of claim 1 wherein the oxygen-containing gas is oxygen.

6. The method of claim 1 wherein, during step (C), step (D) is achieved by providing a continuous ignition source in said tubular communication at the wellhead, said source thereby intercepting the explosive mixture flowing from the isolated portion of the well bore through said communication and initiating the detonation.

7. The method of claim 1 wherein isolation of the upper portion of the well bore adjacent the pay formation is achieved by means of a packer located in the well bore substantially adjacent the upper margin of the tight pay formation.

8. The method of claim 7 wherein a weighty liquid material is introduced into the well bore after positioning of said packer, thereby to form a weighted column on top of the packer and to prevent leakage gas accumulation in the well bore thereabove.

* * * * *